US006433670B1

(12) United States Patent
Miyashita

(10) Patent No.: US 6,433,670 B1
(45) **Date of Patent: *Aug. 13, 2002**

(54) PAGER AND A METHOD OF DISPLAYING THE NUMBER OF MESSAGES RECEIVED BY THE SAME

(75) Inventor: Yukio Miyashita, Shizuoka (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/181,384

(22) Filed: Oct. 28, 1998

(30) Foreign Application Priority Data

Oct. 29, 1997 (JP) ..... 9-312658

(51) Int. Cl.[7] ..... G08B 7/00

(52) U.S. Cl. ..... 340/7.51; 340/7.55; 340/7.58; 340/7.59; 340/7.61; 340/7.62

(58) Field of Search ..... 340/825.44, 7.51, 340/7.55, 7.58, 7.59, 7.61, 7.62; 455/38.1, 38.4, 566, 567

(56) References Cited

U.S. PATENT DOCUMENTS

| | | | | |
|---|---|---|---|---|
| 4,412,217 A | * | 10/1983 | Williard et al. | 340/825.44 |
| 5,347,269 A | * | 9/1994 | Vanden Heuvel et al. | 340/825.44 |
| 5,471,204 A | * | 11/1995 | Kudoh et al. | 340/825.44 |
| 5,793,304 A | * | 8/1998 | Sone | 340/825.44 |
| 6,060,998 A | * | 5/2000 | Miyashita | 340/825.44 |

FOREIGN PATENT DOCUMENTS

| | | |
|---|---|---|
| JP | 2-104032 | 4/1990 |
| JP | H2-153663 | 6/1990 |
| JP | 3-6345 | 1/1991 |
| JP | 5-103059 | 4/1993 |
| JP | 58-501571 | 9/1993 |
| JP | 6-197068 | 7/1994 |
| JP | H9-116650 | 5/1997 |
| JP | 9-153833 | 6/1997 |
| JP | 9-266586 | 10/1997 |
| JP | 10-136420 | 5/1998 |
| JP | 10-173830 | 6/1998 |
| JP | 10-191416 | 7/1998 |
| JP | 10-285305 | 10/1998 |
| JP | 11-27713 | 1/1999 |

* cited by examiner

*Primary Examiner*—Brian Zimmerman
*Assistant Examiner*—Yves DaLencourt
(74) *Attorney, Agent, or Firm*—Scully, Scott, Murphy & Presser

(57) ABSTRACT

The accounting management of a user of a pager receiving a service in which the user is charged for the number of calls is desired to be facilitated by displaying an illustrated image representing the number of received messages within a fixed period of time. In a pager and a method of displaying the number of signals received by the pager including a controller for counting the number of radio signals received and identifying time of the signal reception, a storage for storing therein the counted number of received radio signals, a display having an area for displaying in an illustrated image representing the stored number of received signals, a changing unit for changing the illustrated image in accordance with the number of received signals, and a count period setting unit for setting a fixed period for the counting of the number of received signals. The pager displays an accumulated number of radio signals received during a particular count period set by the count period setting unit.

9 Claims, 5 Drawing Sheets

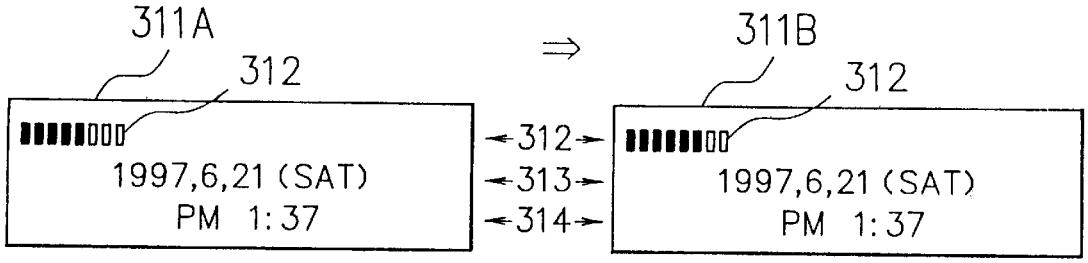
FIG. 3(a)
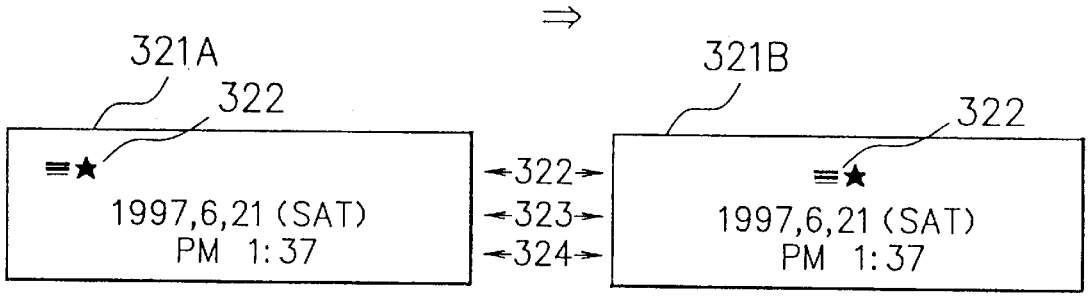
FIG. 3(b)
FIG. 4
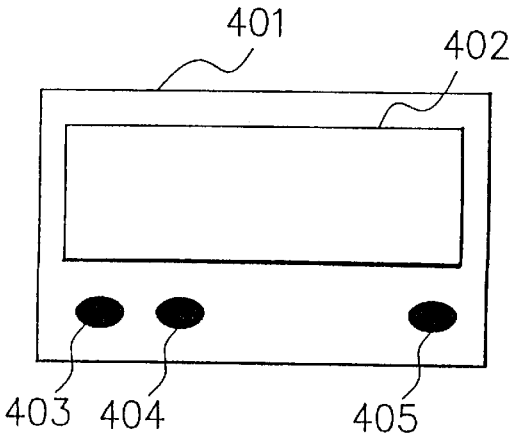

PAGER AND A METHOD OF DISPLAYING THE NUMBER OF MESSAGES RECEIVED BY THE SAME

BACKGROUND OF THE INVENTION

The present invention relates to a pager, and in particular, to a pager having a function to store information such as time of reception of a message and the number of received messages.

Description of the Prior Art

Heretofore, the pager (to be referred to as a receiver when necessary) of this kind has a function to save such information items called in the past as a date and a message. In accordance with the function, there is stored a quantity of information items beforehand determined for each pager such that a person operating the pager can confirm details of each stored items. Or, in a case in which the storage is full of data, when a message is additionally received, old messages are automatically deleted to store the new message.

Japanese Patent Laid-Open Publication of PCT No. 58-501571 describes a technology in which when the last paging call to a pager is displayed, the number of calls received for the paging call is displayed for the user of the pager.

In addition, Japanese Patent Laid-Open No. 2-104032 describes a technology in which when the number of calls becomes greater, the graphic image displayed on an indicator for the user is accordingly changed so that the user of the pager recognizes the number of calls by checking the indicator.

However, the pager described above is attended with a problem that the number of received message cannot be displayed when the message storage capacity is exceeded. Namely, the message count can be confirmed only before the message storage becomes full of messages. In short, once the storage capacity is exceeded, it is impossible to confirm the number of messages accumulated in the storage. To cope with this disadvantage, it has been a common practice that when a message is received with the storage full of data, old messages are deleted to store the received message. This is unsatisfactory for the user because information of deleted messages is lost. For users of pagers receiving a accounting service in which each user is charged in accordance with the number of paging calls received.

In accordance with the pager described in Japanese Patent Laid-Open Publication of PCT No. 58-501571, the number of calls is displayed for the user with respect to a paging call not confirmed, namely, the total number of messages is not displayed and hence it is impossible to solve the problem above.

In the pager of Japanese Patent Laid-Open No. 2-104032, as the number of calls increases, the display is changed in form on the indicator. However, it is impossible to confirm the number of messages received during a desired period of time, that is, the accumulated number of messages is displayed in any case. Consequently, for example, in an accounting system in which the user is charged in accordance with the number of calls per month, it is inconvenient for the user of the pager to manage the monthly charge of the pager.

SUMMARY OF THE INVENTION

It is therefore an object of the present invention to provide a pager in which the illustrated image of the display is altered by comparing the actual number of messages received message with a predetermined number thereof and hence the accumulation of the received messages is facilitated and the accumulated number of messages received during a fixed period of time can be easily obtained, which helps the user of the pager to efficiently manage the charge of the pager.

More specifically, thanks to a count period setting unit to provide the number of messages received during a fixed period of time, the charge management can be more effectively carried out.

In accordance with the present invention, there is provided a pager including receiving means for receiving and decoding a radio signal including at least a paging signal and a message signal subsequent thereto, notifying means for conducting a calling operation at least when the radio signal matches with a paging number of the pager and notifying a message included in the message signal, control means for counting a number of radio signals received and identifying time of reception thereof, storage means for storing therein the counted number of received radio signals, an area of a display for displaying therein an illustrated image of the number stored in the storage means, changing means for changing the illustrated image in accordance with the number of received radio signals, and count period setting means for setting a period of time for the counting of the number of received radio signals.

BRIEF DESCRIPTION OF THE DRAWINGS

The objects and features of the present invention will become more apparent from the consideration of the following detailed description taken in conjunction with the accompanying drawings in which:

FIGS. 3(*a*) and 3(*b*) are diagrams showing display examples of illustrated images of the number of received message in a pager in accordance with the present invention in which 3(*a*) is related to an indicator and 3(*b*) is associated with a display position of the image;

FIG. 4 is a diagram showing an example of constitution of a switch unit in a pager of the present invention.

DESCRIPTION OF THE PREFERRED EMBODIMENTS

Referring next to FIGS. 1 to 6, description will be given of the present invention.

Figure 1:
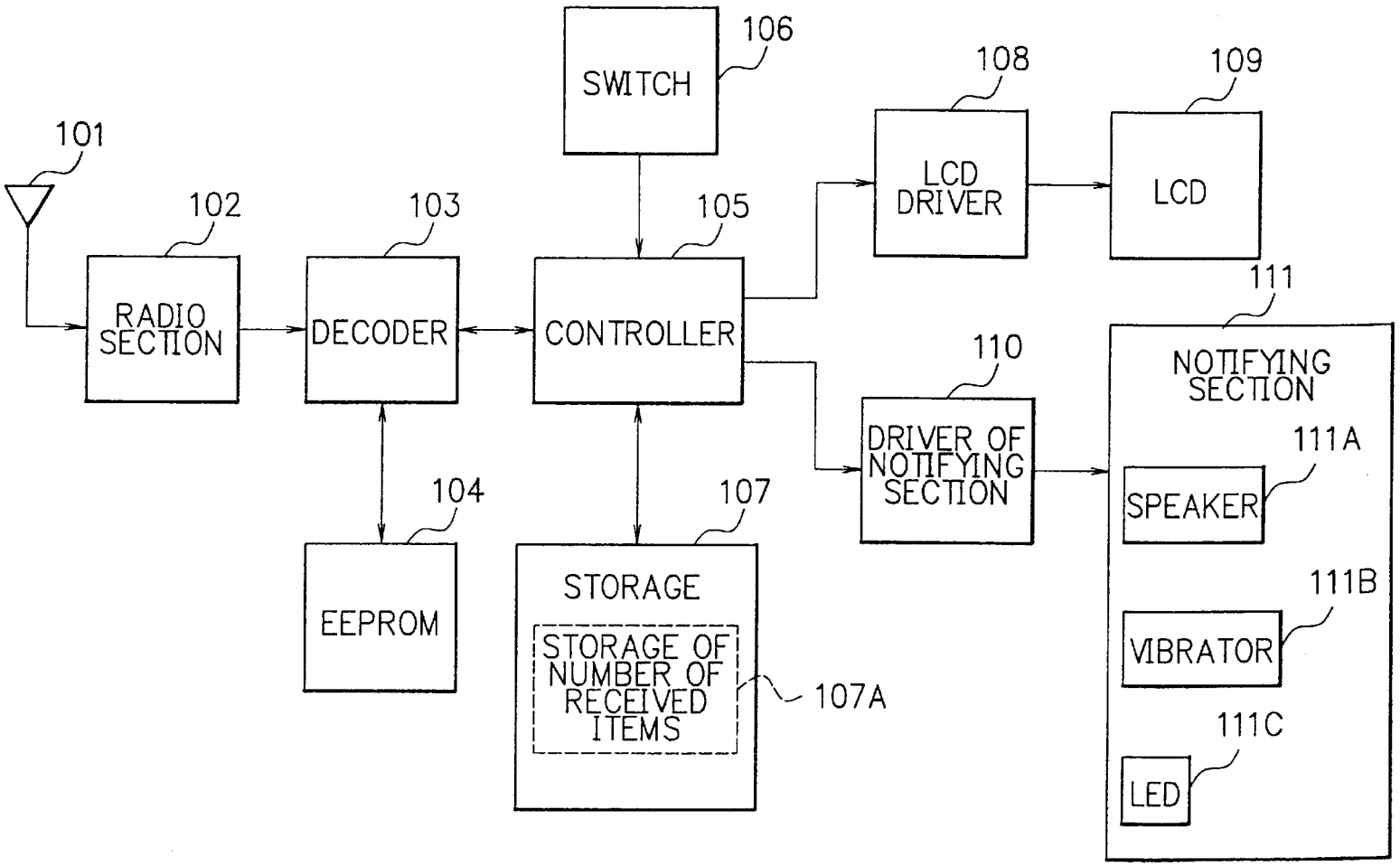
FIG. 1 is a schematic block diagram showing an embodiment of a pager in accordance with the present invention.

FIG. 1 shows in a block diagram an embodiment of a pager in accordance with the present invention. In the description of FIG. 1, it is assumed that the illustrated image of the number of received messages is presented immediately after reception of a message on a liquid crystal display (LCD).

In the pager of FIG. 1, a paging signal from a paging system base station to which the pertinent pager belongs is received by an antenna 101. The signal is demodulated by a radio section 102 and then its waveform is shaped to be transformed into a digital signal. The signal is fed to a decoder section 103 to be decoded so that the paging signal included in the digital signal is compared with its own paging number beforehand written in an electrically erasable programmable read-only memory (EEPROM). When these items match each other, a message signal following the paging signal in the digital signal is delivered from the decoder 103 to a control section 105 which controls operation for the signal. Under supervision of the controller 105, the message signal is stored in a storage section 107 and the value of received messages stored in a received message count area 107A is incremented by one to be stored again in the area 107A. Thereafter, the controller 105 starts operation of a notifying section driver 110 and thereby drives a speaker 111A, a vibrator 111B, or a light emitting diode (LED) unit 111C in a notifying section 111 to resultantly notify a call to a pager user (report a paging call). Furthermore, when the user operates a switch section 106 or a predetermined period of time lapses after the notification is started, the notifying operation is terminated. The controller 105 then drives an LCD driver 108 to display a received message and an illustrated image of the number of received messages on the LCD 109. Although the liquid crystal display 109 corresponds to display means described in claim 1, the present invention is not restricted by the liquid crystal display. Namely, there may be used, for example, a display employing light emitting diodes.

Figure 2:
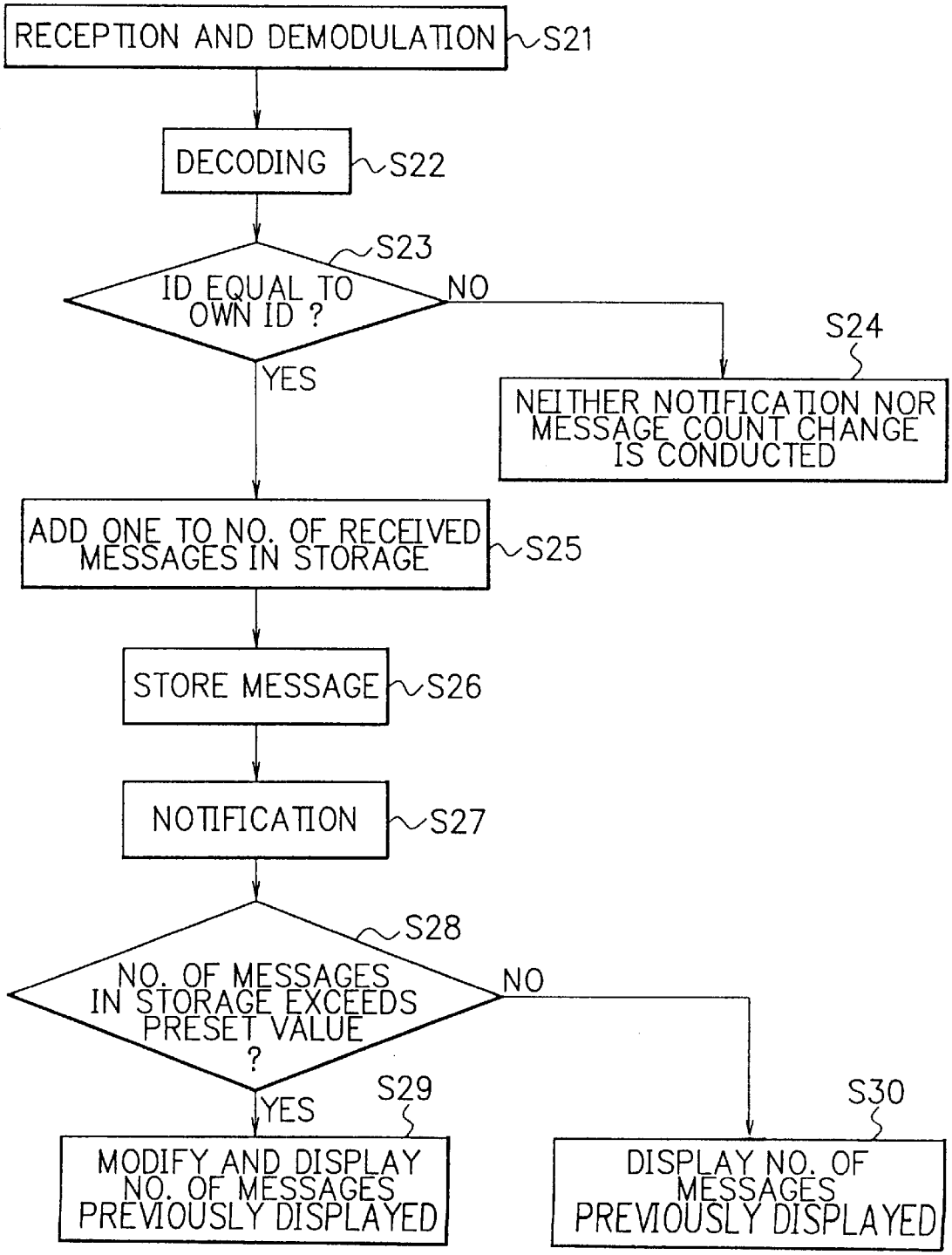
FIG. 2 is a flowchart showing operation to process received messages in the embodiment of the pager configured as shown in FIG. 1.

FIG. 2 shows in a flowchart operation of changing the illustrated image of the message count in the embodiment of the pager.

In the description and FIG. 2, reference numerals such as S21 to S30 represent steps 21 to 30.

The antenna 101 and the radio section 102 receives the paging signal (S21) and the decoder 103 decodes the received signal (S22) to compare the decoded signal with the paging number of the pager stored in the EEPROM 104 (S23). When the comparison results in a mismatching condition (No in S23), the controller 105 conducts neither the notification nor the message count change (S24). However, when a matching condition results (Yes in S23), the controller 105 increments the message count in the area 107A by one and stores the incremented value again therein (S25). Additionally, the controller 105 writes the message signal in the storage 107 (S26) and accomplishes a notifying operation (S27). After the notification is terminated, the controller reads the message count from the storage area 107A to compare the count with a predetermined range beforehand written in the EEPROM 104 (S28). If the count is within the range before the reception of the pertinent message (No in S28), the controller 105 invokes the LCD driver 108 to display the illustrated image of the received count without any modification on the display 109 (S30). However, if the count is beyond the range before the message reception (Yes in S28), the controller 105 alters the illustrated image of the received count and then activates the LCD driver 108 to display the resultant image on the display 109 (S29).

FIGS. 3(*a*) and 3(*b*) shows two examples of message count illustration in the pager of the present invention.

FIG. 3(*a*) shows an example in which the message count is expressed by the quantity of solid rectangles on an indicator 312 and FIG. 3(*b*) is an example in which the count is denoted by the position of an illustrated image of a star 322. The nearer to the right end the image is, the greater is the number of received messages.

FIG. 4 shows an example of constitution of the switch unit in the pager of the present invention.

Figure 5:
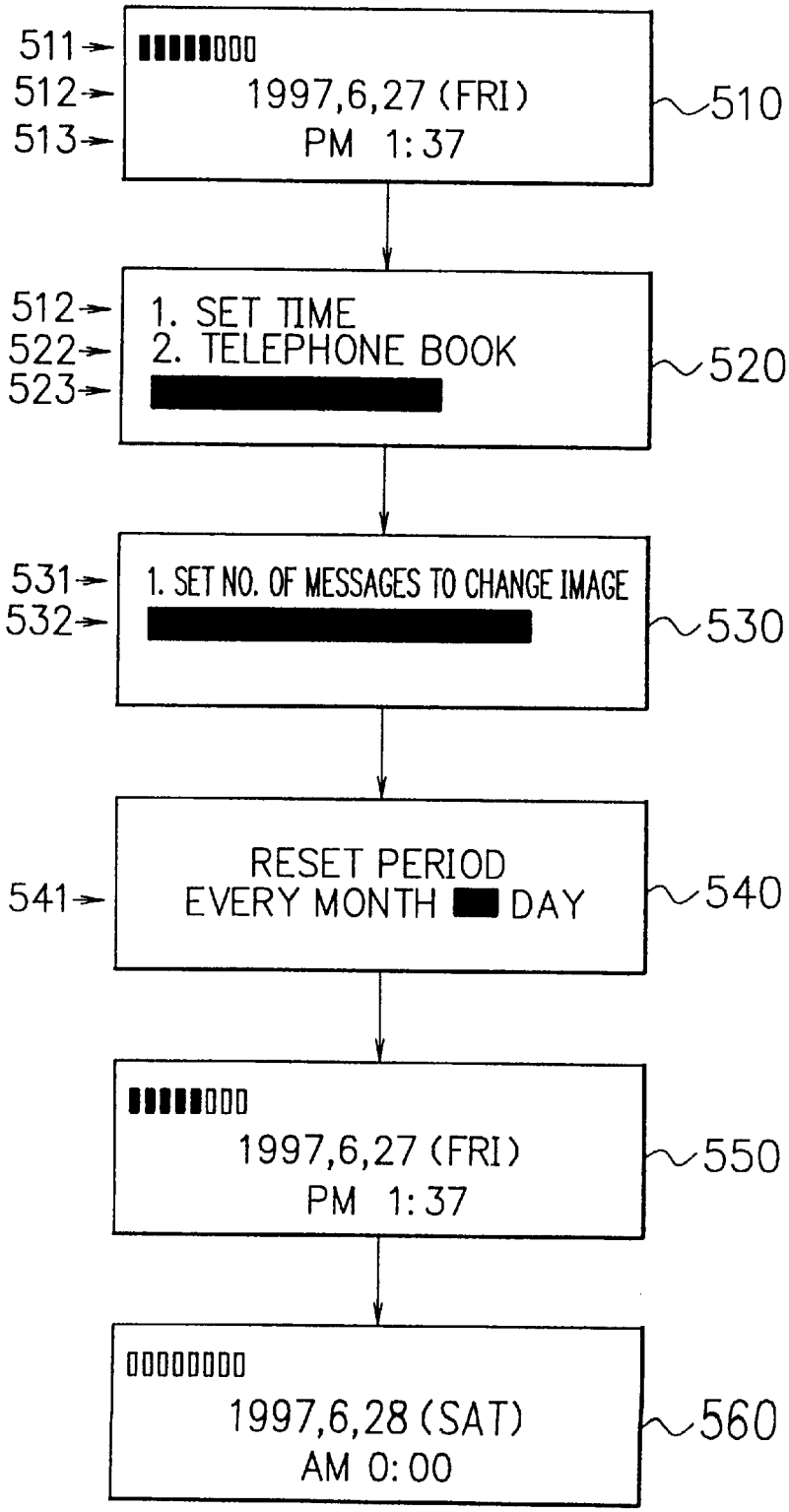
FIG. 5 is a diagram showing an example of setting a counting period of received messages, an example of switch operation, and an example of screen image transition in a pager in accordance with the present invention.

FIG. 5 shows an example of transition of screen images when a period of time to count received messages is set by the switch unit.

Referring now to FIGS. 4 and 5, description will be given of an example in which the date to count received messages is set to the 28th of every month. In FIG. 5, the number of received messages is presented by an indicator 511. When a menu switch 403 is depressed in an ordinary screen 510, there appears a menu screen 520. The message count setting is determined as follows. Selecting a message count setting 523 by a Select switch 405, the operator pushes a Set switch 404. In response thereto, there is displayed a count setting screen 530. The operator selects a reset period setting 532 by the Select switch 405 and then determines the operation by the Set switch 404. After a reset date setting screen 540 is presented, the operator first selects a desired period of time by the Select switch 405 and then depresses the Select switch 404 for the determination of the operation. Characters and letters of the period start blinking. The operator changes the period by the Select switch 405 to Every month and then presses the Select switch 404. The screen image returns to the reset date setting screen 540. The operator then selects the day by the Select switch 405 and depresses the Set switch 404. After the operation is determined, the day starts blinking. The operator selects 28 for the 28th by the Select switch 405 and depresses the Set switch 404 (completion of the setting operation). When the day changes to 28 (image 550 to image 560), the count display 511 is reset.

In this situation, the switches 403 to 405 serve as count period setting units.

With provision above, the user of the pager can confirm by the display the accumulated number of message received during a desired period of time, which facilitates the accounting management. For example, when the pager is set to display the accumulated number of messages up to a predetermined date every month, if the user set the reset date to the monthly charging date, it is possible to appropriately manage the charged amount at the date. Therefore, when compared with a case in which there is displayed the number of messages simply accumulated, for example, only up to the last or first day of the month, the accounting management becomes much more convenient.

Furthermore, after the reset date, the display of the accumulated number of messages is restarted. Consequently, the pager user can confirm at a glance the number of received messages after the reset date for the easier management of the accounting operation. In this regard, it is also possible to store the total number of received messages is stored in storage 107 so as to be read therefrom later for another operation. In addition, the accounting management becomes further efficient when the accumulated number of messages received during the previous count period is continuously displayed or is displayed by use of a switch.

Figure 6:
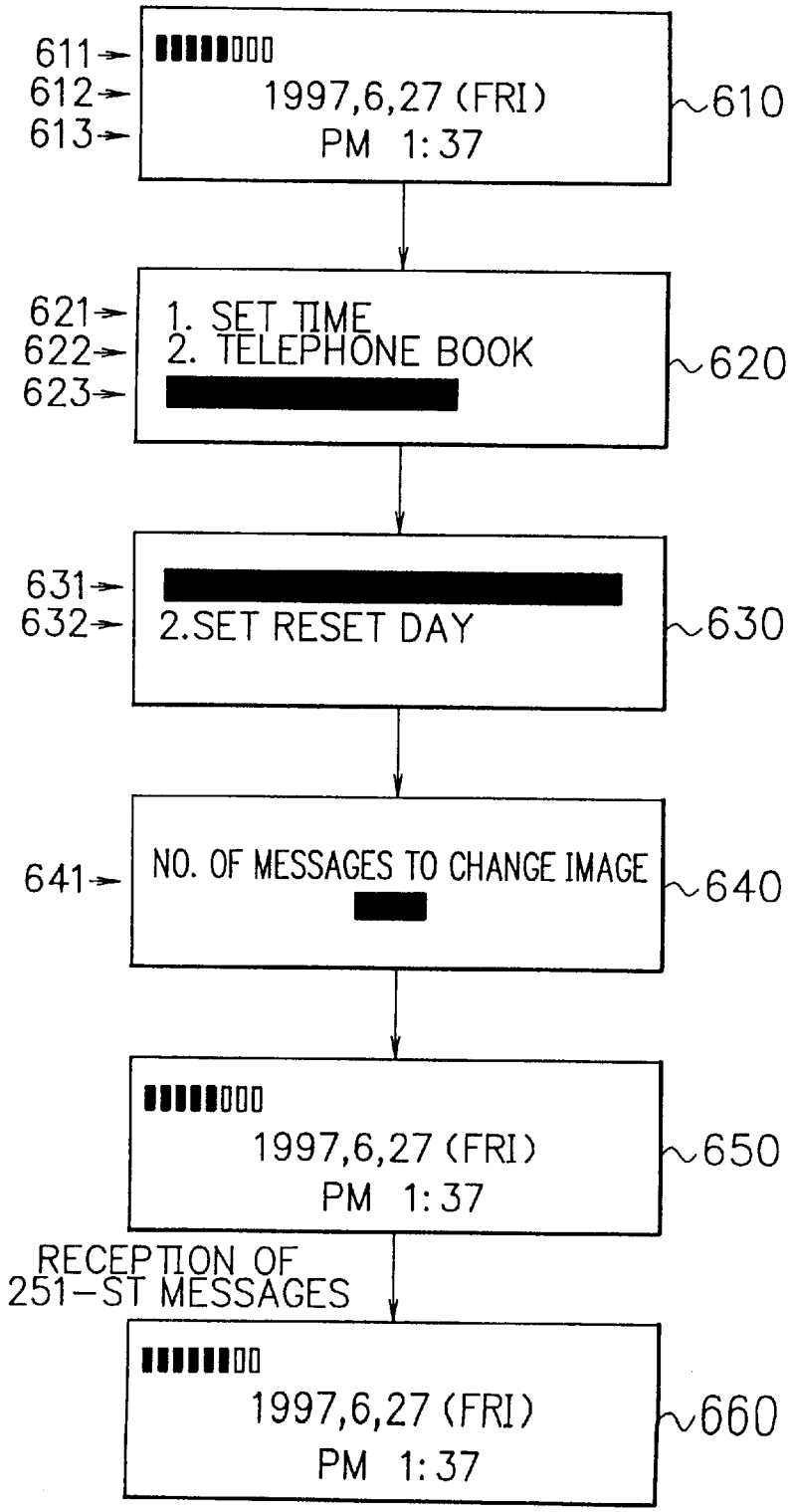
FIG. 6 is a diagram showing an example of setting the number of received messages, an example of switch operation, and an example of screen image transition to change the contents of an illustrated image in a pager in accordance with the present invention.

FIG. 6 is an example of screen transition when the contents of the number of received images to change the illustrated image is set to the pager.

Referring to FIGS. 4 and 6, description will be given of an example in which the contents of the number for the change of the illustrated image is set to 50. FIG. 6 includes the number of received messages 620. In this state, the operator selects a message count setting 623 by the Select switch 405 and depresses the Set switch 404 for the determination of the operation. Subsequently, there appears a count setting screen 630. The operator selects an image changing count setting 632 and then depresses the Select switch 404. Thereafter, the operator selects 50 by the Select switch 405 in a changing count setting screen 640 and depresses the Set switch 404 (completion of the setting operation). Resultantly, the pager is set to a state in which the contents of the illustrated image of the number of received messages is changed each time 50 messages are received. When the 51st message is received (image 650 to image 660), the number of solid rectangles is incremented by one in the indicator 611.

When the image changing count is thus set, the illustrated image can be altered in accordance with the frequency of receptions of each pager user, which further facilitates the charging management for each pager user.

When the reset date of the accumulated number of received messages reaches, the number is reset and the number of received messages starts beginning at zero. Consequently, the illustrated image thereof is also accordingly updated. Thanks to the provision, the pager user can conveniently conduct the accounting management by setting the image changing count corresponding to the frequency of message receptions during the count period set by the count period setting switch.

In accordance with the present invention, there is obtained an advantageous effect that the accounting management becomes easier for the pager user receiving a service in which the charged amount varies depending on the number of calls for the following reason. Namely, there is provided a unit in which the number of radio signals received within a fixed period of time is stored to notify the stored value to the pager user.

Moreover, there is attained an advantage in accordance with the present invention that the charge at the present time can be known at a glance. This is because of a display unit capable of presenting an illustrated image of received message corresponding to the amount of charge.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A pager, comprising:

receiving means for receiving and decoding a radio signal including a paging signal and a message signal subsequent thereto;

notifying means for conducting a calling operation when the radio signal matches with a pager number of the pager;

display means for displaying a message and time included in the message signal;

control means for counting a number of radio signals received and identifying time of reception thereof;

storage means for storing therein the counted number of received radio signals;

an area for displaying therein an illustrated image of the number stored in the storage means;

changing means for changing the illustrated image in accordance with the number of received radio signals; and count period setting means for setting a period of time for the counting of the number of received radio signals.

2. A pager in accordance with claim 1, wherein the count period setting means sets the count period through a switch operation.

3. A pager in accordance with claim 1 or 2, wherein when the count number set for the count period exceeds a count period of a number of received radio signals specified by the count period setting means, an accumulated number of received radio signals is reset.

4. A pager in accordance with claim 1, 2, or 3 wherein the control means includes change count setting means for setting a number of received radio signals for the changing means to change the illustrated image.

5. A pager in accordance with claim 4, wherein the change count setting means sets the number of received radio signals for the change of the illustrated image by a manual operation of a switch.

6. A pager in accordance with claim 4 or 5, wherein:

when the number of received radio signals exceeds the number of radio signals set by the change count setting means, the illustrated image is changed for the display thereof; and when the number of received radio signals is less than or equal to the number of radio signals set by the change count setting means, the illustrated image is displayed without any change thereof.

7. A method of displaying a number of received radio signals for use in a pager described in one of claims 1 to 6, comprising the step of:

resetting, when a count period of received radio signals set by the count period setting means is exceeded, an accumulated number of received radio signals and comparing an actual number of received radio signals with a setting number of received radio signals beforehand set by a change count setting means.

8. A method of displaying a number of received radio signals for use in a pager described in one of claims 4 to 6, comprising the steps of:

receiving a message;

comparing an actual number of received messages with a setting reception count beforehand set by the change count setting means;

displaying an illustrated image beforehand set when the actual number of received message is less than or equal to the setting reception count; and changing, when the actual number of received message exceeds the setting reception count, the illustrated image and displaying the changed image.

9. A method of displaying a number of received radio signals in accordance with claim 8, wherein the setting reception count is set by a switch operation.

* * * * *